US006224391B1

(12) United States Patent
Horie et al.

(10) Patent No.: US 6,224,391 B1
(45) **Date of Patent: *May 1, 2001**

(54) MEMORY CARD ADAPTOR CARD

(75) Inventors: Naoya Horie; Hiroshi Sakurai, both of Osaka; Kiyoshi Washino; Yoshitaka Shobara, both of Kanagawa-ken, all of (JP)

(73) Assignees: Matsushita Electric Industrial Co., Ltd.; Japan Solderless Terminal Mfg. Co., Ltd., both of Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/090,904

(22) Filed: Jun. 5, 1998

(30) Foreign Application Priority Data

Jun. 11, 1997 (JP) ..... 9-153753

(51) Int. Cl.[7] ..... H01R 12/00
(52) U.S. Cl. ..... 439/64; 439/945; 361/737
(58) Field of Search ..... 439/76.1, 945, 439/946, 64; 361/684, 737, 212, 220, 818

(56) References Cited

U.S. PATENT DOCUMENTS

| | | | | |
|---|---|---|---|---|
| 4,905,124 | | 2/1990 | Banjo et al. | 439/737 |
| 5,031,076 | | 7/1991 | Kiku | 361/816 |
| 5,038,250 | | 8/1991 | Uenaka et al. | 439/737 |
| 5,155,663 | | 10/1992 | Harase | 439/945 |
| 5,398,154 | | 3/1995 | Perkins et al. | 439/64 |
| 5,457,601 | * | 10/1995 | Georgopulos et al. | 361/737 |
| 5,490,043 | * | 2/1996 | Tan et al. | 361/818 |
| 5,537,294 | * | 7/1996 | Siwinski | 361/818 |
| 5,653,596 | * | 8/1997 | Banakis et al. | 439/64 |
| 5,833,473 | * | 11/1998 | Betker et al. | 439/76.1 |

FOREIGN PATENT DOCUMENTS

| | | |
|---|---|---|
| 8-31123 | 3/1996 | (JP) . |
| 8-33123 | 3/1996 | (JP) . |
| 8-88059 | 4/1996 | (JP) . |
| 8-235336 | 9/1996 | (JP) . |
| 8-339427 | 12/1996 | (JP) . |
| 9-120439 | 5/1997 | (JP) . |

* cited by examiner

*Primary Examiner*—Tulsidas Patel
*Assistant Examiner*—T. C. Patel
(74) *Attorney, Agent, or Firm*—Smith, Gambrell & Russell, LLP

(57) ABSTRACT

A memory card adaptor card which adapts a memory card compliant with a first standard to a memory card slot compliant with a second standard different from the first standard for electrical connection therebetween. The adaptor card includes a grounding connection mechanism for electrically connecting a grounding contact of the memory card to a grounding circuit of the memory card slot. The grounding connection mechanism includes, for example, a contact spring piece which is to be brought into resilient contact with a contact portion of the memory card and a conductive cover of the adaptor card.

9 Claims, 7 Drawing Sheets

MEMORY CARD ADAPTOR CARD

BACKGROUND OF THE INVENTION

1. Field of the Invention

The present invention relates to a memory card for use in a personal computer (hereinafter referred to as "PC") or a personal digital assistant (hereinafter referred to as "PDA"). Particularly, the invention relates to a memory card adaptor card which allows for installation of a smaller size memory card into a memory card slot of a PC for electrical connection therebetween.

2. Description of Related Art

PC cards conventionally available for PCs and PDAs are standardized by PCMCIA/JEIDA, which specifies the outer dimensions thereof as being 85.6 mm×54.0 mm×5.0 mm (length×width×thickness).

With the size reduction of information devices including PCs and PDAs, smaller size memory cards have been proposed. For example, such a smaller size memory card has a length of 45.0 mm, a width of 42.8 mm and a thickness of 3.3 mm. Attempts have been made to use such new smaller size memory cards in conventional PC card slots which are dominant in the market.

In this connection, memory card adaptor cards have been put to practical application, which allows for installation of a smaller memory card in a memory card slot compliant with a different standard for connection therebetween.

Memory cards often hold significant electrostatic charges before installation thereof into memory card slots. Therefore, it is useful to provide a grounding circuit for dissipating the electrostatic charges prior to connection of signal contacts of the memory card. A grounding device for a PC card is proposed, for example, in Japanese Examined Patent Publication No.8-31123 (1996).

However, an effective grounding mechanism applicable to a memory card adaptor card of a type as proposed by the present invention has not been developed yet. Therefore, a memory card adaptor card having a simple and reliable grounding device has long been desired.

SUMMARY OF THE INVENTION

It is an object of the present invention to provide a memory card adaptor card which ensures reliable grounding with a simplified construction.

The memory card adaptor card according to the present invention includes a grounding connection mechanism for electrically connecting a grounding contact of a memory card to a grounding circuit of a memory card slot.

Therefore, the memory card can discharge an electrostatic charge accumulated therein, whenever the memory card adaptor card of the present invention is installed in the memory card slot after the memory card is installed in the memory card adaptor card. The electrostatic charge escapes through a grounding route extending from the grounding contact of the memory card to the grounding connection mechanism of the memory card adaptor card and to the grounding circuit of the memory card slot.

The memory card adaptor card preferably further includes a first connector which allows a memory card compliant with a first standard to be installed in and electrically connected to the memory card adaptor card, and a second connector which ado allows the memory card adaptor card to be installed in and electrically connected to a memory card slot compliant with a second standard.

In accordance with one embodiment of the present invention, the memory card adaptor card may further include a circuit board, a frame fitted with the circuit board and a cover of a conductive plate which covers the circuit board. In this case, the grounding connection mechanism may include a contact spring piece having first and second bent portions integrally formed, the first bent portion being fixed to the frame in resilient contact with the cover, the second bent portion being adapted to be brought into resilient contact with the grounding contact of the memory card.

With this arrangement, the cover of the conductive plate also serves as a grounding route for the memory card adaptor card, so that electrical connection between the aforesaid grounding route and the grounding contact of the memory card can be established merely by the provision of the contact spring piece.

In this case, the grounding connection mechanism preferably includes a grounding conductor provided on the circuit board and a connector member (short-circuiting metal component 44) for electrically connecting the grounding conductor to the cover.

The memory card adaptor card preferably further includes an abutment member which is to abut against a forward side of the memory card in a process of connecting the memory card to the first connector before complete establishment of electrical connection between the memory card and the first connector. The abutment member may be a projection formed on the cover which covers the circuit board.

The grounding connection mechanism preferably has a contact member which is to be electrically connected to the grounding contact of the memory card in the process of connecting the memory card to the connector before the complete establishment of the electrical connection between the memory card and the connector. The contact member is preferably fixed to the frame of the memory card adaptor card and electrically connected to the conductive cover.

With this arrangement, the memory card can be grounded for discharge of the electrostatic charge before the memory card is electrically connected to the memory card adaptor card.

The grounding connection mechanism preferably has a contact member which is to be electrically connected to the grounding circuit of the memory card slot in a process of installing the memory card adaptor card in the memory card slot before complete establishment of electrical connection between the connector and the memory card slot. In this case, the cover of the conductive plate which covers the circuit board of the memory adaptor card may serve as the contact member.

With this arrangement, the memory card adaptor card can be grounded for discharge of the electrostatic charge before the memory card adaptor card is electrically connected to the slot.

The foregoing and other objects, features and effects of the present invention will become more apparent from the following description of the preferred embodiments with reference to the attached drawings.

DESCRIPTION OF THE PREFERRED EMBODIMENTS

Figure 1:
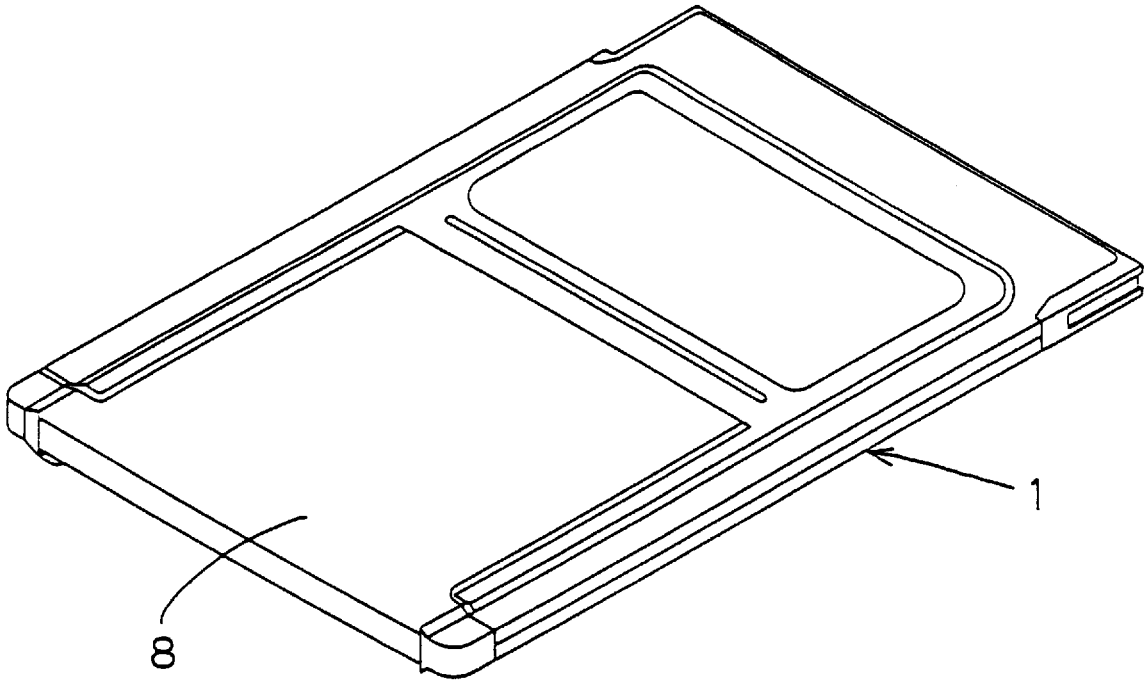
FIG. 1 is an overall perspective view illustrating a memory card adaptor card of the present invention with a memory card installed therein.
Figure 2:
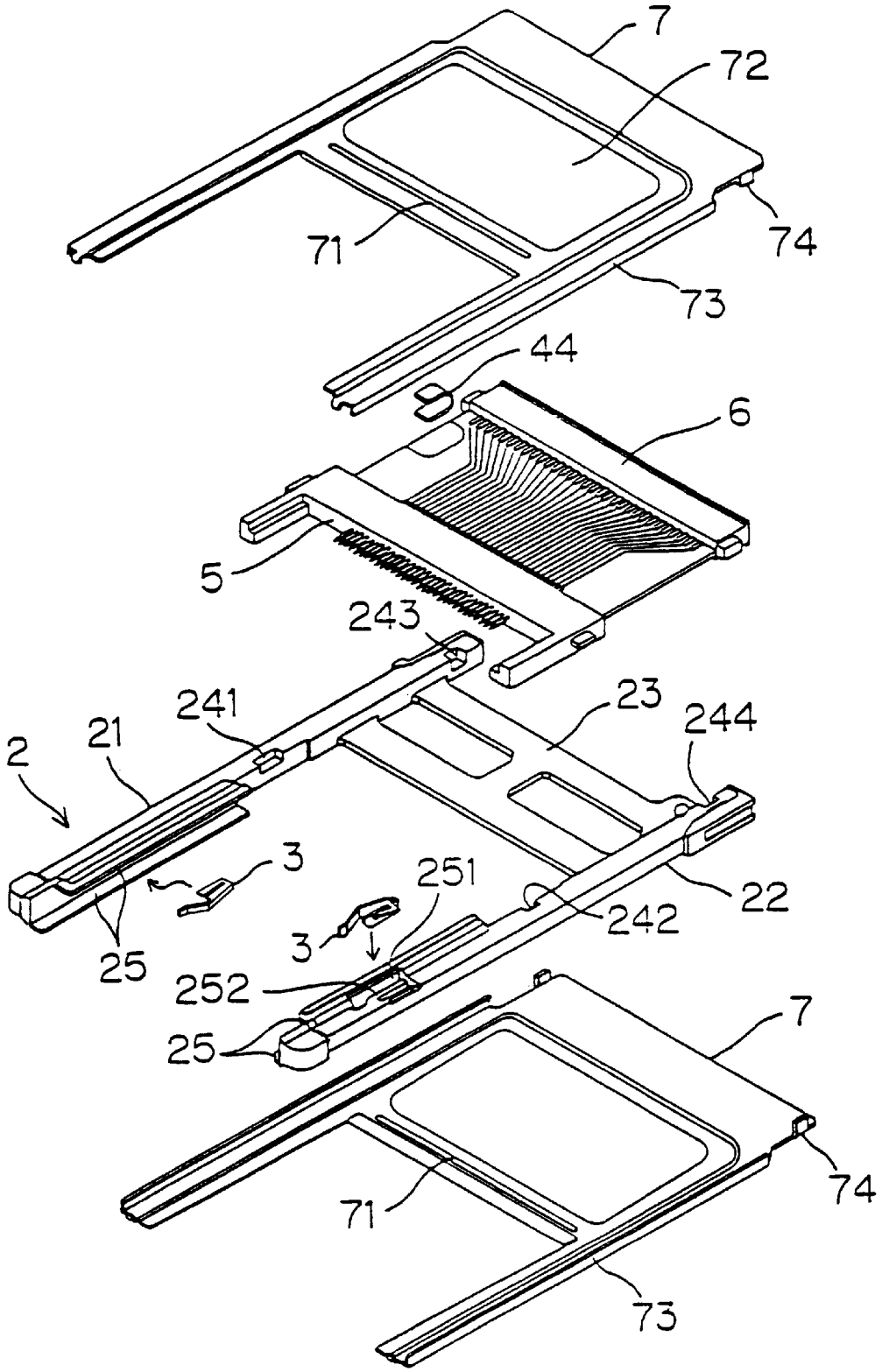
FIG. 2 is an exploded perspective view of the memory card adaptor card.
Figure 3:
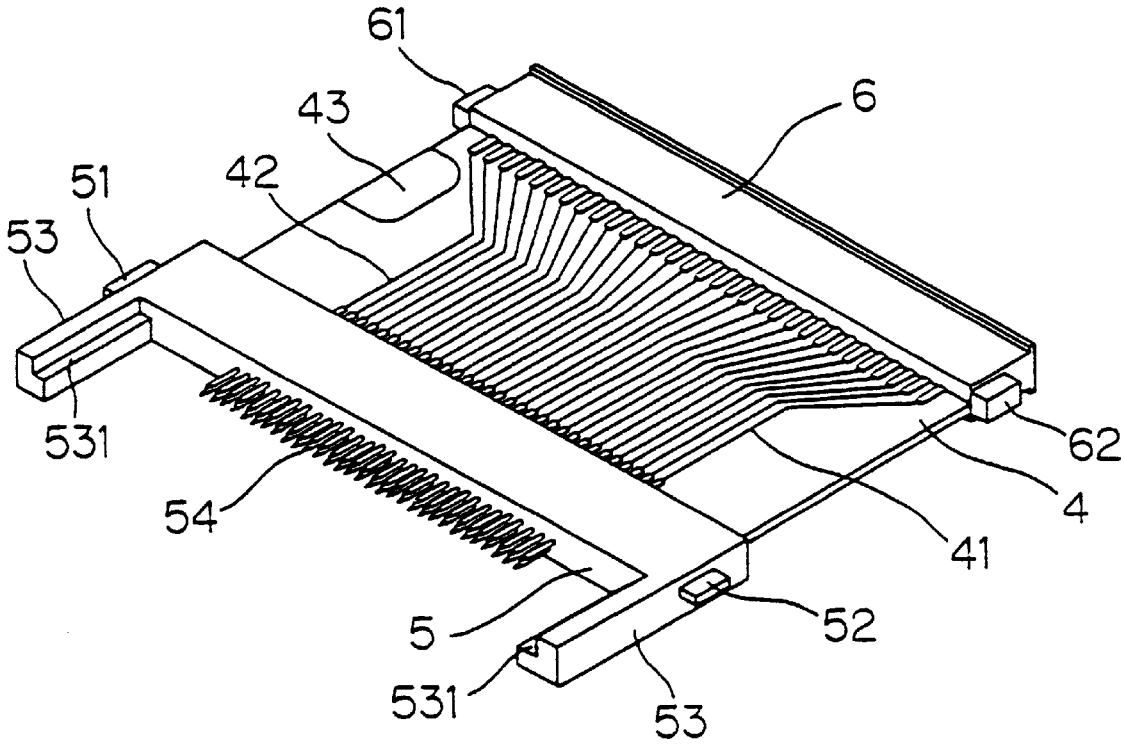
FIG. 3 is a perspective view of a circuit board in the adaptor card.

FIG. 1 is an overall perspective view illustrating a memory card adaptor card of the present invention with a memory card installed therein. FIG. 2 is an exploded perspective view of the memory card adaptor card. FIG. 3 is a perspective view of a circuit board in the adaptor card.

A memory card adaptor card 1 includes a frame 2, a pair of contact spring pieces 3, and a circuit board 4. The circuit board 4 is provided with a first connector 5 on its forward side relative to the direction of insertion of a memory card 8 and with a second connector 6 on its opposite rearward side. The circuit board 4, the first connector 5 and the second connector 6 constitute a single assembly. The frame 2 and the assembly including the circuit board 4 are covered with upper and lower covers 7.

The frame 2 includes left and right side beams 21 and 22 provided in an opposed relation and a cross beam 23 extending between the side beams 21 to 22 to link portions thereof a little rearward of their middles. The side beam 21 has recesses 241 and 243 respectively formed in a generally middle portion and a rear end portion of a surface thereof opposed to the side beam 22. The side beam 22 has recesses 242 and 244 respectively formed in a generally middle portion and a rear end portion of a surface thereof opposed to the side beam 21. The recess 241 has a larger size than the other recesses.

Upper and lower guide rails 25 project from each of opposed surfaces of the side beams 21 and 22. The upper guide rail 25 of the side beam 22 has a window 251 and an engagement portion 252 formed therein, which are in an opposed relation it to the interior surface of the upper cover 7. Similarly, the lower guide rail 25 of the side beam 21 has a window 251 and an engagement portion 252 (not shown) formed therein, which are in an opposed relation to the interior surface of the lower cover 7. The frame 2 is a component injection-molded from a synthetic resin.

The circuit board 4 has a plurality of signal circuit conductors 41, 41, 41, . . . and a grounding conductor 42 formed as a printed wiring pattern on an insulating plate such as of a phenol resin and coated with a green resist. A reference numeral 43 denotes an exposed printed wiring which is connected to the grounding conductor 42 in a position not shown in the figure.

The circuit board 4 is a two-side wiring board for pattern formation of the multiple signal circuit conductors. In this embodiment, wirings for a total of 68 pin terminals, i.e., 34 wirings on each surface of the circuit board 4, for the signal circuit conductors and the grounding conductor are provided on sides both side of the circuit board 4. In this case, the wiring pitch is 1.0 mm on the forward side, the smaller pitch side. It is noted that the number of signal circuit conductors and the wiring pitch vary depending on the standard with which the memory card is compliant. Memory card adaptor cards may be designed in compliance with any other standard.

The first connector 5 and the second connector 6 are respectively attached to the forward side and rearward side of the circuit board 4 with the terminals thereof soldered to the corresponding conductors. The first connector 5 serves to electrically connect the circuit board 4 to the memory card 8 (see FIG. 4), while the second connector 6 serves to electrically connect the circuit board 4 to a memory card slot 91 provided in a PC 9 or the like (see FIG. 7).

The first connector 5 has rectangular engagement projections 51 and 52 projecting from right and left side faces thereof, respectively. The engagement projection 51 is larger than the engagement projection 52. The first connector 5 further has guide plates 53, 53 projecting in an opposed relation forwardly of opposite edge portions of a front face thereof. The guide plates 53, 53 respectively have cut-away step portions 531, 531 on their opposed surfaces. The first connector 5 has 68 contact pins 54 implanted on the front face thereof. These contact pins 54 extend through the connector 5 and project to the circuit board 4, and are soldered to the corresponding conductors on the circuit board 4. The contact pins 54 are aligned in two rows, i.e., in upper and lower rows.

Similarly, the second connector 6 has rectangular engagement projections 61 and 62 projecting from right and left side faces thereof, respectively. The engagement projections 61 and 62 have the same size as the engagement projection 52.

The upper and lower covers 7 are each formed from a conductive metal plate. The covers 7 each have right and left arms formed by squarely cutting away a front middle portion from the conductive metal plate, and a generally rectangular portion connected to proximal ends of the pair of arms. When the memory card adaptor card is fabricated, the assembly including the circuit board 4 and the frame 2 are sandwiched between the pair of covers 7.

The covers 7 each include bent edges 73 extending along opposite side edges thereof from their front ends and projecting upright from the opposite side edges, and bent claws 74 provided adjacent to rear ends of the opposite side edges. The bent edges 73 and the bent claws 74 are integrally formed from the conductive metal plate. Upon the fabrication of the memory card adaptor card, the bent edges 73 serve as grounding contacts for the adaptor card, and both the bent edges 73 and bent claws 74 serve as conductors for electrically connecting the covers 7 to each other.

The bent edges 73 are connected to frame grounding terminals (not shown) in the memory card slot 91 of the PC 9 (see FIG. 7) to form a grounding circuit.

Each of the covers 7 has a projection 71 and a protuberance 72. The projection 71 is a ridge-like projection projecting inwardly of the cover and extending perpendicularly to the direction of the insertion of the memory card, and serves to strengthen a portion of the cover 7 adjacent to the opening not supported by the frame 2. The protuberance 72 is a square protuberance raised outwardly of the cover, and serves to strengthen the cover 7 and increase the interior space of the adaptor card. The projection 71 may be of any other shape, or an additional projection member, instead of the projection 71, may be mounted on the cover 7 for abutment against the memory card 8.

Figure 4:
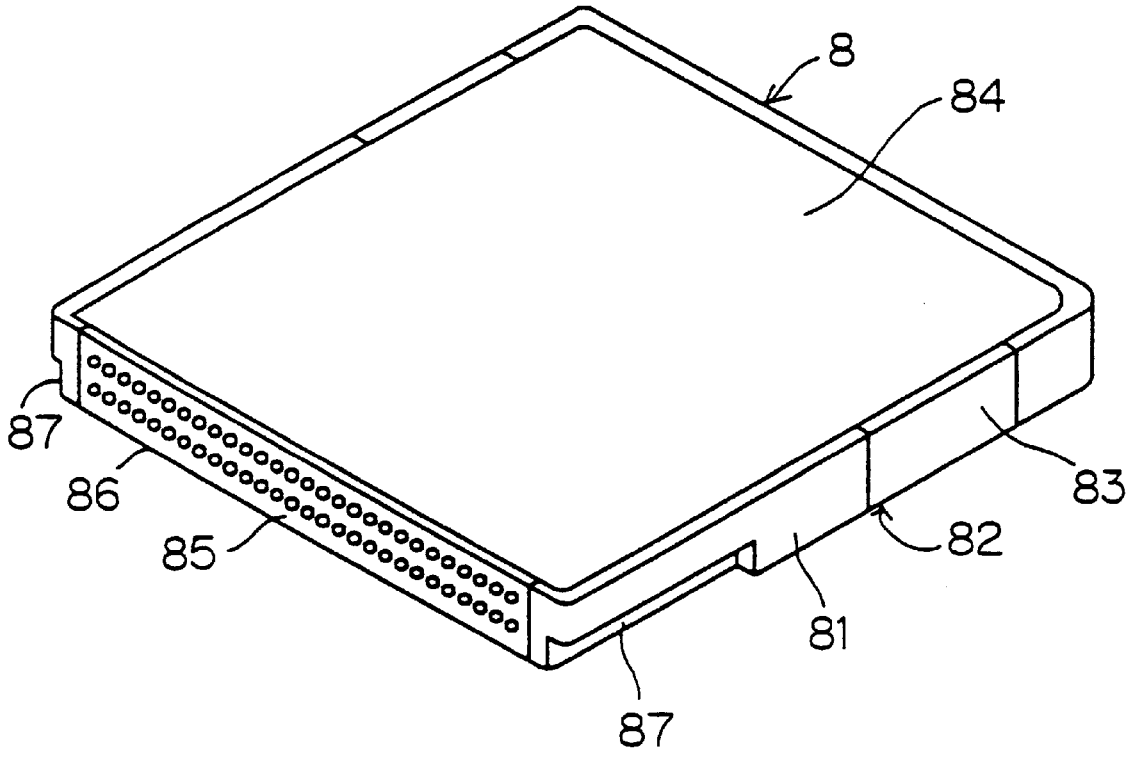
FIG. 4 is a perspective view illustrating the appearance of the memory card.

FIG. 4 is a perspective view illustrating the appearance of the memory card 8. The exterior of the memory card 8 is defined by a generally U-shaped frame 81 produced by injection molding and generally square upper and lower covers 84 and 82 each formed of a thin metal plate. Incorporated in the memory card 8 is an assembly of a printed circuit board (not shown) and a connector 85 connected thereto by soldering, on which circuit board memory ICs such as a RAM and a ROM are mounted and wired.

The lower cover 82 includes bent pieces which are fitted on opposite side faces of the frame 81 and serve as grounding contacts 83, 83. The grounding contacts 83 and 83 also provide electrical connection between the upper and lower covers 84 and 82. A reference numeral 86 denotes a front face of the memory card 8, and a reference numeral 87 denotes steps provided at front end portions of opposite side faces of the memory card 8.

Figure 5:
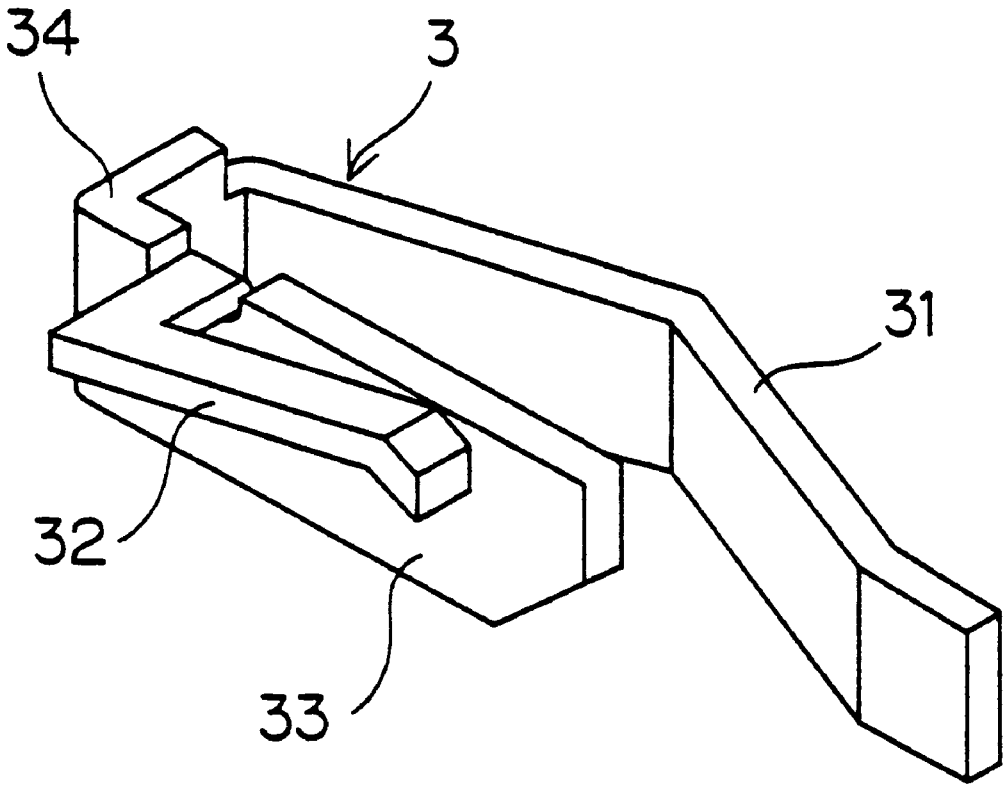
FIG. 5 is a perspective view of a contact spring piece.

The construction of the contact spring piece 3 will be described in detail with reference to FIG. 5. FIG. 5 is an enlarged perspective view of the contact spring piece 3. The contact spring piece 3 is a press-formed metal component. In consideration of the spring resilience, phosphor bronze is a preferable material for the contact spring piece 3.

The contact spring piece 3 has two bent portions 31 and 32, a link portion 34 and a support portion 33 for keeping the bent portions 31 and 32 resilient, all of which are integrally formed. The bent portion 31 is of a chevron shape and adapted to be brought into slidable contact with the grounding contact 83 of the memory card. The bent portion 32 is inclined upwardly and adapted to be brought into resilient contact with the cover 7 of the memory card adaptor card 1 to establish electrical contact therebetween when the adaptor card 1 is fabricated.

Figure 6:
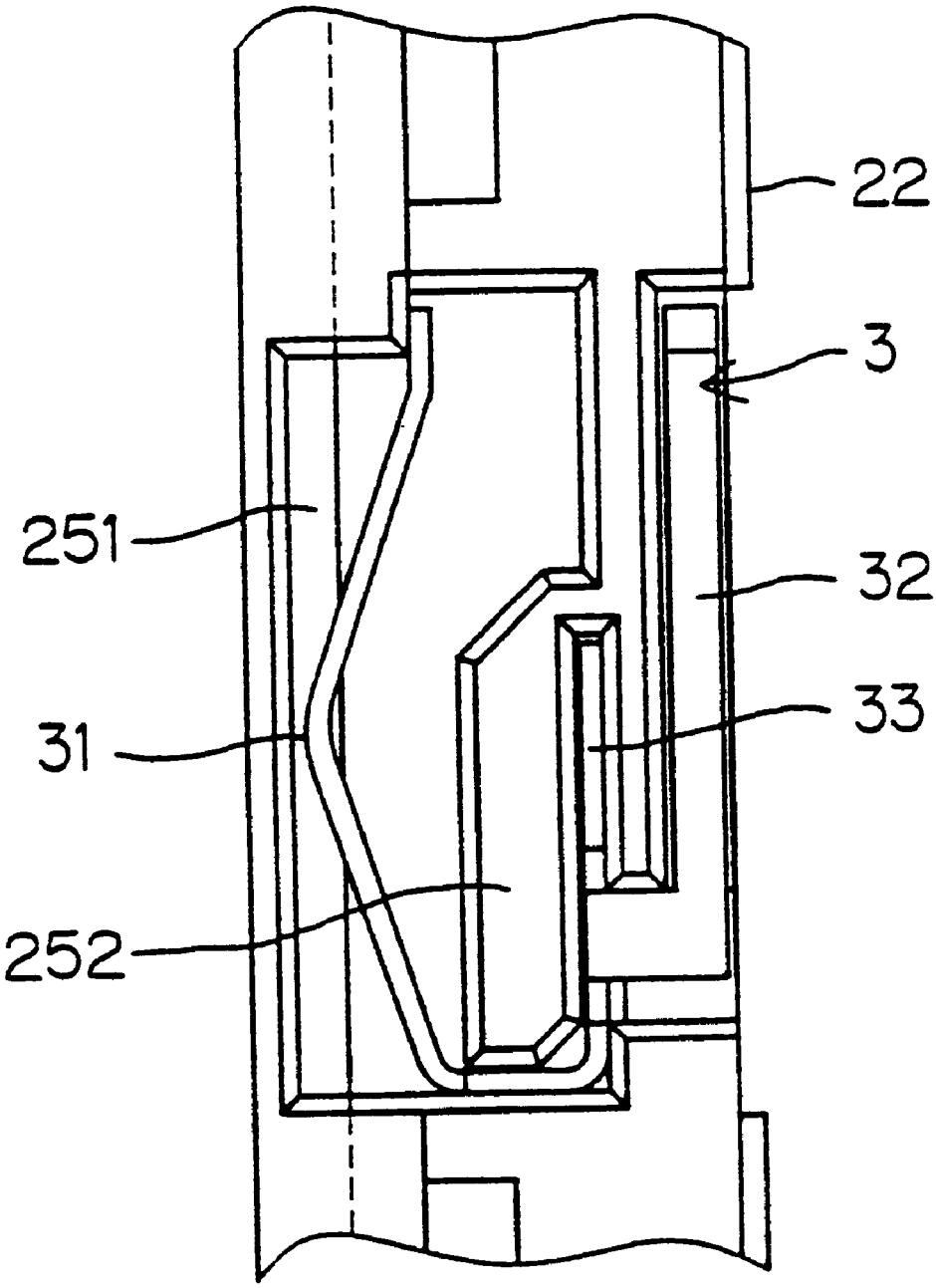
FIG. 6 is an enlarged view illustrating the contact spring piece fixed to a side beam of a frame.

FIG. 6 is an enlarged plan view illustrating the contact spring piece 3 fixed to the side beam 22 of the frame 2. A contact spring piece receiving portion is formed in each of the side beams, and has the window 251 which ensures easy insertion and fixing of the contact spring piece 3. The engagement portion 252 is of a generally U-shape, and projects in the window 251.

The contact spring piece 3 is inserted within the window 251 with the support portion 33 fixed in the generally U-shaped engagement portion 252. Thus, the bent portions 31 and 32 are kept in resilient contact with the grounding contact 83 and the cover 7.

Next, an explanation will be given to engagement of the respective components.

The assembly of the circuit board 4 and the connectors 5 and 6 is fixed to the frame 2 shown in FIG. 2. At this time, the engagement projections 51 and 52 of the first connector 5 are inserted in and engaged with the recesses 241 and 242, respectively, of the frame 2. Similarly, the engagement projections 61 and 62 of the second connector 6 are inserted in and engaged with the recesses 243 and 244, respectively, of the frame 2. Since the engagement projection 51 and the recess 241 are larger than the other projections and recesses, the circuit board 4 is prevented from being mounted on the frame 2 in a wrong orientation, i.e., in an upside-down orientation or in a front-side-back orientation.

A reference numeral 44 in FIG. 2 denotes a short-circuiting metal component. Upon completion of fabrication of the memory card adaptor card 1, the upper cover 7 and the grounding conductor 43 are short-circuited by the short-circuiting metal component 44. Though not shown, the lower cover 7 and the grounding conductor 43 on the rear surface of the circuit board 4 are short-circuited in the same manner. The short-circuiting metal component 44 is a U-shaped bent component. The short-circuiting metal component 44 can automatically be mounted on the grounding conductor 43 by means of an automatic mounting machine which holds a top portion thereof. The short-circuiting metal components 44 are a connection means for connecting the grounding conductors 43 to the covers 7 of the memory card adaptor card 1.

In another embodiment, the short-circuiting of the grounding conductors and the upper and lower covers can be achieved by any other short-circuiting means, for example, by inserting the circuit board-in the midst of a coil spring.

The memory card 8 is inserted into the thus fabricated memory card adaptor card 1 from the forward side thereof for electrical connection between the memory card 8 and the memory card adaptor card 1. More specifically, the memory card 8 is first guided by the two pairs of guide rails 25, 25 provided on the side beams 21 and 22 of the frame 2 with proper clearances therebetween during insertion thereof. The memory card 8 is then guided by the right and left guides 53, 53 projecting forward from the first connector 5 with proper clearances therebetween during further insertion thereof. During this insertion process, edge portions of the upper and lower surfaces of the memory card 8 are brought into slidable and intimate contact with the left and right arms of the covers 7.

Along with the step portions 531, 531 of the guides 53, the steps 87, 87 formed on the side faces of the memory card 8 prevent the memory card 8 from being mistakenly inserted into the adaptor card 1 in an upside-down orientation. More specifically, when the memory card 8 is inserted in a correct orientation, the steps 87 engage the step portions 531 for correct installation of the memory card 8. On the other hand, when the memory card 8 is mistakenly inserted in an upside-down orientation, the steps 87 abut against the step portions 531 to prevent the memory card 8 from being further inserted.

Just before the completion of the insertion of the memory card 8, the upper and lower edges of the front face of the memory card 8 slightly abut against the projections 71, 71 provided on the interior surfaces of the covers 7, 7 of the memory card adaptor card. By applying a force to the memory card 8 in the insertion direction in this state, the installation of the memory card 8 in the memory card adaptor card 1 is completed, whereby the electrical connection to the first connector 5 is established. Since the memory card 8 is connected to the first connector 5 after the slight abutment, the electrostatic charge is completely discharged from the memory card 8 through a grounding route which is electrically connected to the memory card 8 just before the completion of the installation of the memory card 8 as will be described later and, in addition, the contact pins 54 of the first connector 5 are prevented from being damaged. Further, this arrangement allows an operator to have a tactile feedback such that the memory card 8 is just to be connected to the first connector 5. Therefore, the operator can slowly and assuredly perform the memory card inserting operation.

Figure 7:
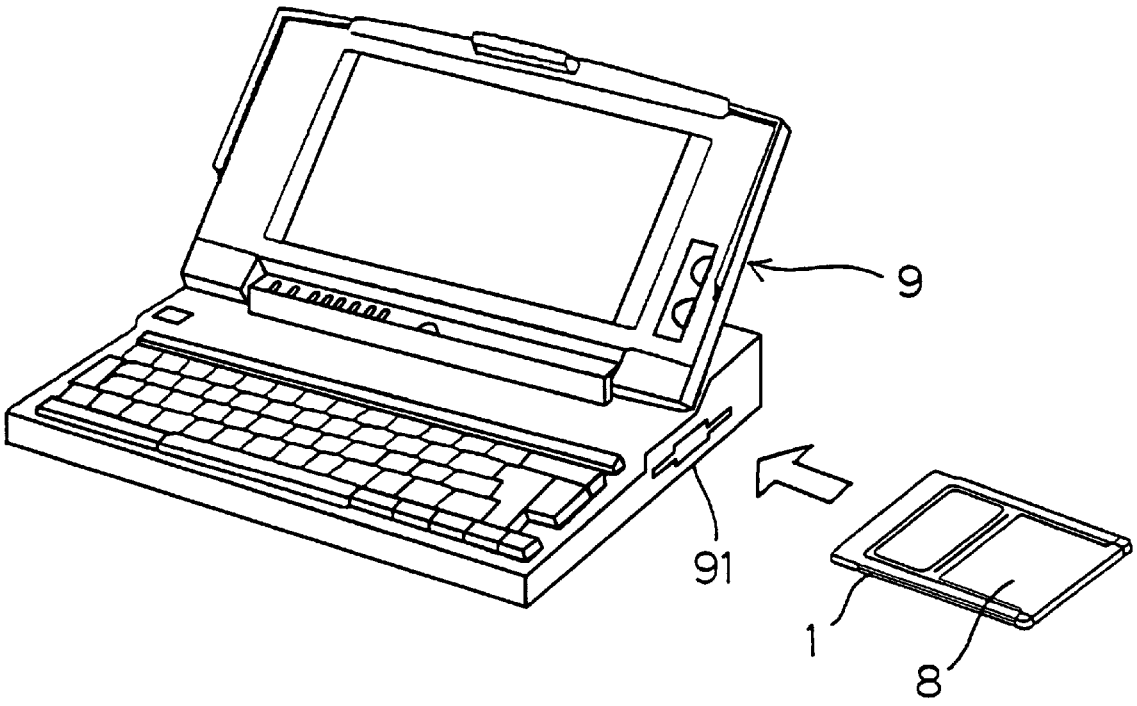
FIG. 7 is a schematic perspective view illustrating a PC and the memory card adaptor card with the memory card installed therein.

As shown in FIG. 7, the smaller size memory card 8 is installed in the memory card adaptor card 1 of the present invention, which is then inserted into the memory card slot 91 of the PC 9 compliant with the different standard.

In this embodiment, three grounding routes, i.e., first, second and third grounding routes are defined. The first grounding route extends from the grounding conductors 42 of the circuit board 4 to the grounding circuit of the memory card slot 91 through the second connector 6. The second grounding route extends from the bent edges 73 of the memory card adaptor card 1 to the grounding circuit of the memory card slot 91 through frame grounding terminals (not shown) provided in the memory card slot 91 and having substantially the same construction as the contact spring pieces 3. The third grounding route extends from the grounding conductors 42 and 43 of the circuit board 4 to the grounding circuit of the memory card slot 91 through the short-circuiting metal components 44, the bent edges 73 of the memory card adaptor card and the frame ground terminals of the memory card slot 91.

The first grounding route dissipates electrostatic charges accumulated in the signal circuit conductors to reduce noise, and the second grounding route provides a chassis grounding for the memory card 8 and the adaptor card 1. The third grounding route dissipates a significantly large electrostatic charge accumulated in the first grounding route for some reasons. Although a single grounding route offers a satisfactory grounding effect, the provision of the combination grounding routes ensures a more reliable and trouble-free grounding mechanism.

In accordance with this embodiment, electrostatic charges accumulated in the memory card 8 and the memory card adaptor card 1 can assuredly be discharged to the memory card slot 91 compliant with the different standard whenever the memory card adaptor card 1 is installed in the slot 91. Further, the grounding connection mechanism of the memory card adaptor card 1 is constituted by the covers 7 of the conductive metal plate serving as the circuit conductor, thereby requiring only the contact spring piece 3 additionally be provided. Therefore, the memory card adaptor card 1 can readily be fabricated at reduced costs.

In addition, the projection 71 provided on the cover 7 of the memory card adaptor card 1 gives an operator a tactile feedback such that the memory card 8 is just to be connected to the connector 5; therefore, the operator can slowly and assuredly perform the memory card installing operation. Thus, the grounding connection can be established prior to the signal connection to the connector 5. Accordingly, the memory card 8, circuit components of the memory card adaptor card 1 and circuit components of the PC 9 to be connected to the memory card adaptor card 1 are protected from adverse effects of the electrostatic charges.

Although the exterior of the memory card adaptor card is defined by the upper and lower covers each formed of a conductive metal plate in accordance with the embodiment described above, the exterior may be defined by two separate covers or a single cover prepared by folding a large conductive plate. Further, a conductive resin component and a plated component may be used in combination as the cover.

Although the contact spring piece employed in the embodiment described above is a single piece component, such contact spring piece may include a plurality of components which can readily be formed by press working to be later combined together to ensure an intended effect.

The memory card adaptor card according to the present invention can be applied to various combinations of memory cards and memory card slots compliant with Different standards besides the combination of the memory card slot and the smaller size memory card shown in the embodiment described above. It is noted that various modifications may be made within the scope of the present invention by incorporating commonly utilized techniques and mechanisms.

While the present invention has been described in detail by way of an embodiment thereof, it should be understood that the foregoing disclosure is merely illustrative of the technical principles of the present invention but not limitative of the same. The spirit and scope of the present invention are to be limited only by the appended claims.

This application claims priority benefits under 35 USC Section 119 on the basis of Japanese Patent Application No. 9-153753 filed in the Japanese Patent Office on Jun. 11, 1997, the disclosure thereof being incorporated herein by reference.

What is claimed is:

1. A memory card adaptor card for adapting a memory card compliant with a first standard to a memory card slot compliant with a second standard different from the first standard for electrical signal connection and electrical grounding connection therebetween, the memory card being provided with signal contacts on an end face thereof and a grounding contact on a side thereof, the memory card slot being provided with a grounding contact for connecting the grounding contact of the memory card to a grounding circuit when the memory card is inserted in the memory card slot, the memory card adaptor card comprising:

a grounding connection mechanism for electrically connecting the grounding contact of the memory card to the grounding contact of the memory card slot, said grounding connection mechanism contacting said memory card grounding contact at a side of said adaptor card.

2. A memory card adaptor card for adapting a memory card compliant with a first standard to a memory card slot compliant with a second standard different from the first standard for electrical signal connection and electrical grounding connection therebetween, the memory card adaptor card comprising:

a grounding connection mechanism for electrically connecting a grounding contact provided on the memory card to a grounding circuit provided in the memory card slot in order to establish said electrical grounding connection;

a circuit board for providing said electrical signal connection;

a frame fitted with the circuit board; and a cover of a conductive plate which covers the circuit board;

wherein the grounding connection mechanism includes a contact spring piece having first and second bent portions integrally formed, the first bent portion being fixed to the frame in resilient contact with the cover, the second bent portion being adapted to be brought into resilient contact with the grounding contact of the memory card.

3. A memory card adaptor card as set forth in claim 2, wherein the grounding connection mechanism further includes:

a grounding conductor provided on the circuit board; and a connector member for electrically connecting the grounding conductor to the cover.

4. A memory card adaptor card as set forth in claim 1, further comprising:

a connector which allows the memory card to be installed in and electrically connected to the memory card adaptor card; and an abutment member which is to abut against a forward side of the memory card in a process of connecting the memory card to the connector before complete establishment of the electrical connection between the memory card and the connector.

5. A memory card adaptor card as set forth in claim 4, further comprising:

a circuit board; and a cover which covers the circuit board;

wherein the abutment member is a projection formed on the cover.

6. A memory card adaptor card as set forth in claim 1, further comprising:

a connector which allows the memory card to be installed in and electrically connected to the memory card adaptor card, wherein the grounding connection mechanism includes a contact member which is to be electrically connected to the grounding contact of the memory card in a process of connecting the memory card to the connector before complete establishment of the electrical connection between the memory card and the connector.

7. A memory card adaptor card as set forth in claim 6, further comprising:

a circuit board;

a frame fitted with the circuit board; and a cover of a conductive plate which covers the circuit board;

wherein the contact member is fixed to the frame and electrically connected to the cover.

8. A memory card adaptor card as set forth in claim 1, further comprising:

a connector which allows the memory card adaptor card to be installed in and electrically connected to the memory card slot;

wherein the grounding connection mechanism includes a contact member which is to be electrically connected to the grounding circuit of the memory card slot in a process of installing the memory card adaptor card in the memory card slot before complete establishment of the electrical connection between the connector and the memory card slot.

9. A memory card adaptor card as set forth in claim 8, wherein the contact member includes a cover of a conductive plate which covers a circuit board provided in the memory card adaptor card.

* * * * *